US005875942A

United States Patent [19]

Ohmi et al.

[11] Patent Number: 5,875,942

[45] Date of Patent: Mar. 2, 1999

[54] HINGED CAP SEPARABLE FROM BOTTLE AT THE TIME OF DISPOSAL

[75] Inventors: Hidehiko Ohmi; Tateo Kubo; Mitsuo Kumata, all of Hiratsuka, Japan

[73] Assignee: Japan Crown Cork Co., Ltd., Japan

[21] Appl. No.: 786,509

[22] Filed: Jan. 21, 1997

[30] Foreign Application Priority Data

Mar. 22, 1996 [JP] Japan ..... 8-066536
Aug. 23, 1996 [JP] Japan ..... 8-222018

[51] Int. Cl.[6] ..... B65D 55/02

[52] U.S. Cl. ..... 222/556; 222/153.07; 215/253; 215/237

[58] Field of Search ..... 222/556, 541.5, 222/541.1, 541.6, 541.9, 153.06, 153.07; 215/274, 237, 238, 253, 254

[56] References Cited

U.S. PATENT DOCUMENTS

| | | | |
|---|---|---|---|
| 4,782,964 | 11/1988 | Poore et al. | 222/153.07 |
| 4,895,282 | 1/1990 | Robinson | 222/541.9 |
| 5,240,155 | 8/1993 | Mueller et al. | 222/541.1 |
| 5,301,849 | 4/1994 | Gugliemini et al. | 222/541.9 |
| 5,588,562 | 12/1996 | Sander et al. | 222/541.6 |
| 5,601,215 | 2/1997 | Stolz | 222/541.9 |

FOREIGN PATENT DOCUMENTS

| | | |
|---|---|---|
| 0 214 095 A | of 0000 | European Pat. Off. . |
| 06 059 247 U | of 0000 | Japan . |
| 07 009 751 U | of 0000 | Japan . |
| WO 92 17379 A | of 0000 | WIPO . |

*Primary Examiner*—Steven O. Douglas
*Attorney, Agent, or Firm*—Fulbright & Jaworski L.L.P.

[57] ABSTRACT

A hinged cap comprising a cap body, an outer cylinder formed integrally with said cap body so as to cover the outer surfaces of said cap body and said skirt portion, and an upper closure coupled by hinges to the upper end portion of said outer cylinder, wherein the skirt portion of said cap body is provided with a plurality of slits extending in the axial direction maintaining a distance in the circumferential direction, the skirt portion of said cap body and said outer cylinder are separated away from each other via cut surfaces but are formed integrally together via a plurality of breakable bridge portions and are formed on the upper side or the lower side of the cut surfaces, and the outer surface of the skirt portion of the cap body and the inner surface of the outer cylinder are intimately contacted to each other at the cut surfaces in a state where at least the cap body is fitted to the mouth of the container. The cap has a highly reliable sealing structure and, after used, can be easily removed from the mouth of the container without using any tool. The cap can be produced through a series of steps and offers excellent tamper-evidence.

7 Claims, 3 Drawing Sheets

HINGED CAP SEPARABLE FROM BOTTLE AT THE TIME OF DISPOSAL

BACKGROUND OF THE INVENTION

1. Field of the Invention

The present invention relates to a hinged cap separable from bottle at the time of disposal. More specifically, the invention relates to a hinged cap that is strongly fitted and secured to the mouth of a container but that can be easily removed from the mouth of the container without using any special tool, and that offers excellent sealing and tamper-evidence.

2. Description of the Prior Art

Plastic caps have an excellent moldability, exhibit excellent flexibility and can, hence, be strongly fitted and secured to the mouths of containers by the capping operation to maintain high degree of sealing.

In many cases, however, the plastic caps are used for a glass bottle and the plastic containers made of materials different from the cap materials. To meet the demands for reusing the resources and for separating the cap from the bottle at the time of disposal, it has been desired to easily remove the caps from the mouths of the containers without using a tool such as cutter or the like.

There have been proposed a variety of caps separable from bottle at the time of disposal. For example, Japanese Utility Model Laid-Open No. 59247 /1994 discloses a container closure comprising a cap body fitted and secured to the mouth of a container, a cylinder screwed to the cap body, and an overcap coupled by hinges to the cylinder. In the container closure, the cap body comprises a top plate portion having a breaking portion for forming a flow-out port, a side wall coupled integrally to the peripheral edge of the top plate, and an inner ring that downwardly extends from the inner surface of the top plate portion maintaining a suitable gap from the side wall. That is, the cap body is secured to the mouth of the container as the mouth of the container is fitted to between the side wall and the inner ring. Besides, the side wall is formed being broadened toward the back thereof or has a plurality of slits extending in the direction of height maintaining a suitable distance in the circumferential direction, so that the cap body can be removed from the mouth of the container without using any special tool. Furthermore, a screw thread is formed on the upper outer peripheral surface of the side wall to hold the cylinder. When the cylinder is engaged with, and held by, the side wall, the side wall is pushed by the cylinder and is firmly held by the mouth of the container to maintain good sealing.

According to the container closure of the above prior art, the cylinder formed integrally with the overcap is turned, so that the cap body is removed from the side wall. Thus, the cap body can be easily removed by hand from the mouth of the container and can, hence, be separated easily from the container at the time of disposal.

Furthermore, Japanese Utility Model Laid-Open No. 9751/1995 discloses a container closure comprising an inner plug fitted and secured to the mouth of the container, an outer cylinder and an overcap. Like the cap body mentioned above, the inner plug of the container closure has, formed in the top plate portion thereof, a breaking portion for forming a flow-out port, and permits the mouth of the container to be fitted between the side wall and the inner ring. Moreover, the top plate portion has an annular erected portion that is so formed as to surround the breaking portion, and the overcap is fitted being screwed about the outer surface of the erected portion. The outer cylinder is so provided as to surround the outer peripheral surface of the side wall of the inner plug, the outer cylinder and the side wall of the inner plug are formed integrally together via a weakened portion, and a reinforcing ring is fitted in space between the inner surface of the outer cylinder and the outer surface of the side wall. That is, in a state where the container closure is fitted to the mouth of the container, the side wall of the inner plug is pushed onto the wall of the mouth of the container by the reinforcing ring, whereby the inner plug is firmly secured to the mouth of the container to maintain good sealing. The outer cylinder can be easily torn away from the inner plug by breaking the weakened portion. With the outer cylinder being torn away from the inner plug, the side wall is no longer pushed by the reinforcing ring. Therefore, the inner plug can be removed from the mouth of the container without using any special tool. As described above, this container closure can be separated easily from the container at the time of disposal. Besides, the container closure offers tamper-evidence since the inner plug is removed from the mouth of the container after the outer cylinder is torn away from the inner plug.

However, the former container closure, i.e., the container closure of Japanese Utility Model Laid-Open No. 59247/1994 does not offer tamper-evidence. That is, the container closure is removed by breaking neither the cylinder formed integrally with the cap nor the cap body. Therefore, even if the container closure that was once removed from the mouth of the container is fitted again to the mouth of the container, this fact cannot at all be recognized by a third person. Furthermore, this container closure is constituted by the two molded articles, i.e., constituted by the cap body and the cylinder formed integrally with the overcap. Therefore, the container closure cannot be produced by one time of molding. Besides, the two molded articles that are produced must be coupled together, leaving a problem of low productivity.

Furthermore, the latter container closure, i.e., the container closure disclosed in Japanese Utility Model Laid-Open No. 9751/1995 is constituted by three molded articles of an inner plug molded integrally with the outer cylinder, an overcap and a reinforcing ring, and can be produced very inefficiently even compared with the former container closure. Besides, the inner plug formed integrally with the outer cylinder has a complex triple-wall structure consisting of inner ring, side wall and outer cylinder. In addition, a separately molded reinforcing ring must be fitted between the side wall and the outer cylinder. Accordingly, the metal mold becomes complex, and the inner plug that is molded must have a high dimensional precision. Moreover, there remains a probability in that the reinforcing ring falls down prior to effecting the capping operation, which is a serious defect from the standpoint of production.

SUMMARY OF THE INVENTION

It is therefore an object of the present invention to provide a hinged cap which is free from the defects of the above-mentioned conventional container closures, can be easily separated from the container at the time of disposal, offers excellent tamper-evidence, easily molded and produced, and is effectively prevented from being broken at the time of capping.

According to the present invention, there is provided a hinged cap, comprising:

a cap body including a top plate portion and a skirt portion, the top plate portion having a flow-out port or having a portion for forming the flow-out port, the skirt portion having a protrusion formed on the inner surface thereof to engage with the mouth of a container;

an outer cylinder formed integrally with said cap body so as to cover the outer surfaces of said cap body and said skirt portion; and an upper closure coupled by a hinge to the upper end portion of said outer cylinder;

wherein the skirt portion of said cap body is provided with a plurality of slits extending in the axial direction maintaining a distance in the circumferential direction, the skirt portion of said cap body and said outer cylinder are separated away from each other via cut surfaces but are formed integrally together via a plurality of breakable bridge portions and are formed on the upper side or on the lower side of the cut surfaces, and the outer surface of the skirt portion of the cap body and the inner surface of the outer cylinder are intimately contacted to each other at the cut surfaces in a state where at least the cap body is fitted to the mouth of the container.

In the hinged cap of the present invention, it is desired that the peripheral edge of the upper surface of the top plate portion of the cap body is provided with a small peripheral protrusion, and the inner surface of the upper closure has a horizontal surface that comes into contact with the upper end of the peripheral protrusion.

When the top plate portion of the cap body has a portion for forming the flow-out port, it is desired that the portion is provided with a tab for opening.

In the hinged cap of the present invention, the outer cylinder protects the skirt portion of the cap body at the time of capping. In a state where the mouth of the container is closed, the outer cylinder comes into intimate contact with the outer surface of the skirt portion of the cap body via cut surfaces to maintain the sealing. At the time of opening the cap, the outer cylinder is pushed up or pushed down to break the breakable bridge portions, so that the outer cylinder is removed integrally with the upper closure. With the outer cylinder being removed, the skirt portion of the cap body can be easily separated from the mouth of the container without using any tool.

The hinged cap of the type in which the top plate portion of the cap body has a portion for forming the flow-out port, offers good tamper-evidence.

It is very important that the cap of the present invention comprises the cap body, outer cylinder and upper closure that are molded integrally. That is, the upper closure is coupled by a hinge to the outer cylinder which is molded integrally with the skirt portion of the cap body via the breakable bridge portions. Therefore, the cap of the present invention is produced through substantially a single molding step featuring a very high productivity.

Furthermore, the skirt portion of the cap body is provided with a plurality of slits extending in the axial direction maintaining a distance in the circumferential direction. When the outer cylinder is removed, therefore, the skirt portion outwardly expands in the radial direction, facilitating the removal of the cap body from the mouth of the container.

According to the present invention, furthermore, the skirt portion of the cap body and the outer cylinder are separated from each other via cut surfaces but are molded integrally together via the breakable bridge portions on the upper side or on the lower side of the cut surfaces. Besides, the outer surface of the skirt portion of the cap body is brought into intimate contact with the inner surface of the outer cylinder at the cut surfaces.

That is, with the skirt portion and the outer cylinder being intimately contacted at the cut surfaces, the skirt portion of the cap body is hooped by the outer cylinder in a state where the mouth is at least sealed; i.e., the skirt portion is prevented from outwardly expanding, and the mouth of the container is reliably sealed. This is particularly important in the case of the cap of the present invention in which the skirt portion is provided with slits extending in the axial direction. That is, the slits in the skirt portion work to weaken the engagement between the mouth of the container and the protrusion of the skirt portion. With the skirt portion being hooped by the outer cylinder, however, strong and reliable engagement is accomplished.

A plurality of breakable bridge portions are provided on the upper side or on the lower side of the cut surfaces to couple the skirt portion of the cap body to the outer cylinder. Therefore, slits in the cut surfaces do not adversely affect the bridge portions. At the time of capping operation, furthermore, the outer surface of the skirt portion of the cap body comes into intimate contact with the inner surface of the outer cylinder at the cut surfaces. Therefore, the external force is prevented from acting on the breakable bridge portions, and the bridge portions are protected during the capping operation.

The small peripheral protrusion is formed at the peripheral edge on the upper surface of the top plate of the cap body, and the horizontal surface is formed on the inner surface of the top closure over the whole periphery to come into contact with the upper end of the peripheral protrusion when the upper closure is closed. During the capping operation or when the cap is being conveyed or supplied, therefore, the peripheral protrusion works as a stopper, and the pressure acting on the upper closure is received by the peripheral protrusion. Accordingly, the external force is more effectively prevented from acting upon the bridge portions, and the bridge portions are perfectly protected.

When the outer cylinder is pushed up or pushed down, furthermore, deviation takes place between the outer cylinder and the skirt portion on the cut surfaces, and the bridge portions coupling the cap body to the outer cylinder are cut due to the shearing force. Slits are formed in the skirt portion of the cap body. When the outer cylinder is removed from the skirt portion, therefore, the skirt portion is allowed to expand outwardly in the radial direction. Accordingly, the cap body can be easily separated away from the mouth of the container, and the mouth of the container can be easily opened without using any tool.

The outer cylinder that is removed proves that the cap body has already been removed from the mouth of the container. Therefore, the hinged cap of the type in which the top plate portion of the cap body has a portion for forming the flow-out port, offers improved tamper-evidence owing to the outer cylinder.

According to the present invention, the skirt portion of the cap body, outer cylinder and upper closure are injection-molded or compression-molded integrally and, then, a slit is formed by using a cutter or the like between the skirt portion of the cap body and the outer cylinder, and the portions except the bridge portions are separated from each other. Therefore, the cap can be easily produced by molding using an ordinary metal mold which comprises a core and a cavity.

In the present invention, furthermore, the skirt portion of the cap body and the outer cylinder can be coupled together through the bridge portions as well as through a coupling portion that cannot be broken. In this case, the outer cylinder and the cap body can be removed together from the mouth of the container after the bridge portions have been broken.

Furthermore, a weakened line can be formed in the outer cylinder upwardly extending from the lower end thereof. The outer cylinder can be easily removed by breaking along the weakened line.

PREFERRED EMBODIMENTS OF THE INVENTION

The invention will now be described in detail with reference to the accompanying drawings.

Figure 1:
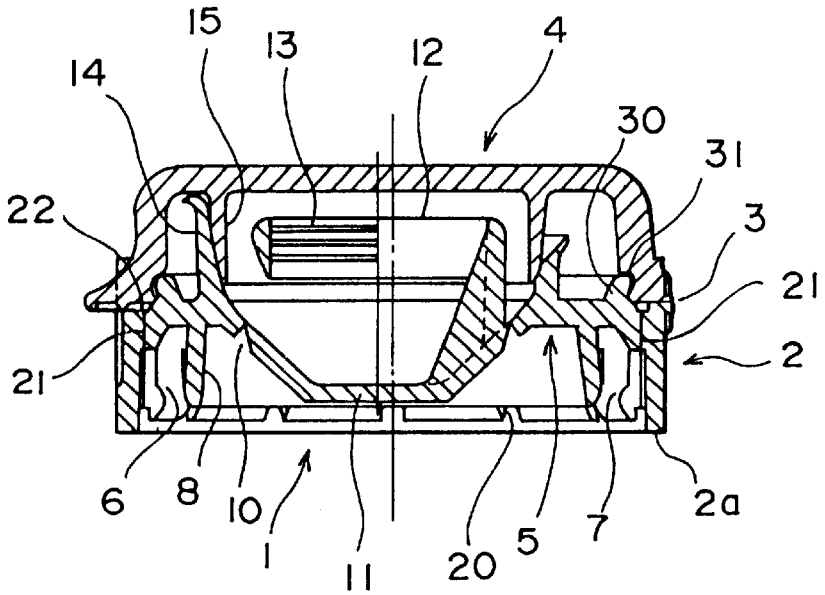
FIG. 1 is a side view illustrating a hinged cap according to an embodiment of the present invention.
Figure 2A:
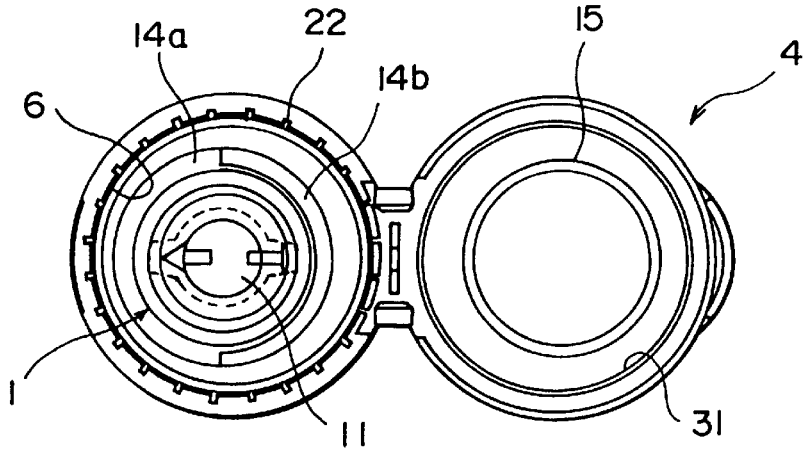
FIG. 2 is a view illustrating a state where an upper closure of the hinged cap of FIG. 1 is opened, wherein the diagram (A) is a top view, the diagram (B) is a side view, and the diagram (C) is a bottom view.
Figure 2B:
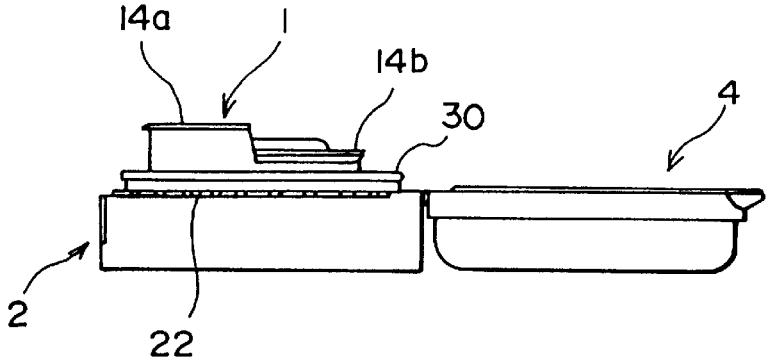
Figure 2C:
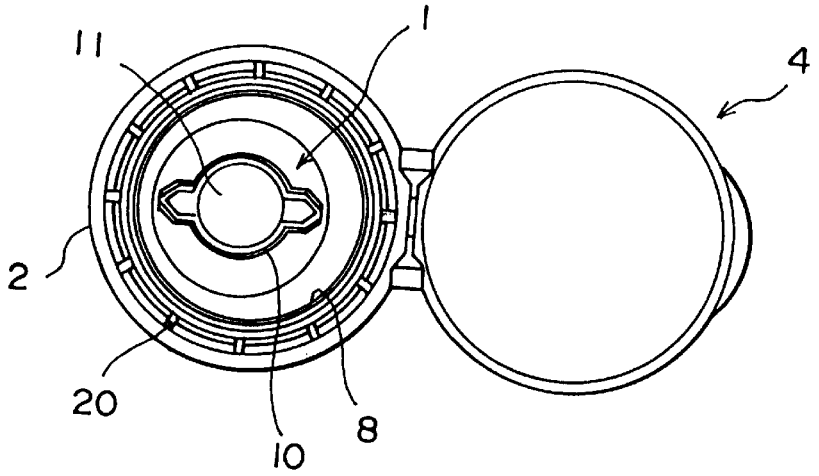

Referring to a side sectional view (FIG. 1) illustrating a hinged cap according to an embodiment of the present invention, a view (FIG. 2, wherein the diagram is a top view, the diagram B is a side view and the diagram C is a bottom view) illustrating a state where the upper closure of the hinged cap of FIG. 1 is opened, and a side sectional view (FIG. 3) illustrating a state where the hinged cap is fitted to the mouth of the container, the hinged cap of the present invention roughly comprises a cap body 1, an outer cylinder 2 connected thereto, and an upper closure 4 coupled by a hinge 3 to the upper end of the outer cylinder 2. As will be understood from FIGS. 1 and 2, the upper closure 4 is turned and closed to completely cover the cap body 1 (FIG. 1) and is turned and opened, so that the cap body 1 is exposed (FIG. 2). Then, a tab 13 is torn away, and a liquid contained in the container is poured out. The cap body 1 comprises a top plate portion 5 and a skirt portion 6 hanging down from the outer periphery thereof.

Figure 4:
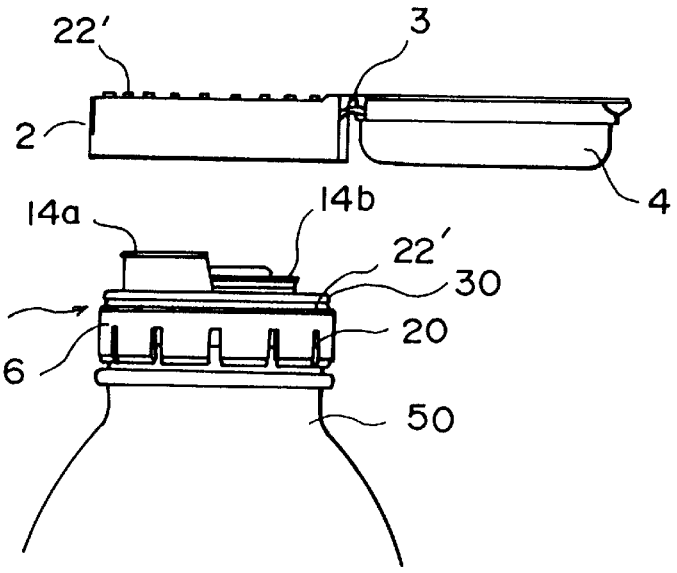
FIG. 4 is a view illustrating a state where an outer cylinder and the upper closure are removed together from a cap body fitted to the mouth of the container.

FIG. 4 illustrates a state where the outer cylinder 2 and the upper closure 4 are removed from the cap body 1 that is fitted to the mouth 50 of the container.

Figure 3:
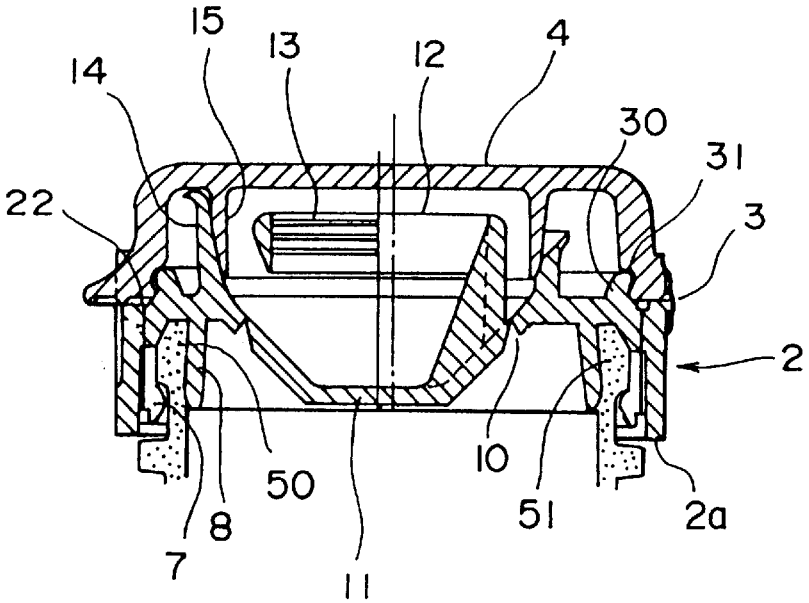
FIG. 3 is a side sectional view illustrating a state where the hinged cap of FIG. 1 is fitted to the mouth of the container.

As best shown in FIG. 3, a protrusion 7 is formed along the inner periphery of the skirt portion 6 to come into engagement with a recessed portion 51 of the outer peripheral side of the mouth 50 of the container, so that the mouth 50 of the container comes into intimate contact with the inner surface of the upper plate portion 5 to accomplish the sealing. In this embodiment, furthermore, an inner ring 8 is formed on the inner surface of the upper plate portion 5 to come into engagement with the inner peripheral side of the mouth 50 of the container, whereby the sealing is accomplished even on the inner peripheral side of the mouth 50 of the container to accomplish more reliable sealing.

Referring to FIGS. 1 and 3, furthermore, the upper plate portion 5 of the cap body 1 has a portion 11 for forming a flow-out port is formed by a score 10. The portion 11 is provided with a tab 12 for opening. When the opening tab 12 is pulled, the score 10 is broken, the flow-out port is formed in the portion 11, and the liquid contained in the container is poured out through the flow-out port. Here, it is desired that the opening tab 12 is provided with a knurled protrusion 13 for preventing the slipping, so that it can be easily pulled by hand.

A peripheral protrusion 14 is formed on the outer surface of the top plate portion 5 so as to surround the portion 11 for forming the flow-out port. In pouring out the liquid, the peripheral protrusion 14 works as a guide so that the liquid is smoothly poured out.

On the inner surface of the upper closure 4 is formed a peripheral downwardly oriented protrusion 15 which, when the upper closure 4 is closed, comes into intimate contact with the inner peripheral surface of the peripheral protrusion 14. That is, even in a state where the flow-out port has been formed in the portion 11, the port is completely closed when the upper closure 4 is closed to maintain favorable sealing. Referring to FIGS. 1 and 2(A), it is desired that the peripheral protrusion 14 surrounding the portion 11, is tall along a half peripheral portion 14*a* on the side opposite to the side where the outer cylinder 2 and the upper closure 4 are coupled together by the hinge 3, and is short along a half peripheral portion 14*b* on the side of the hinge 3. This is because, when the upper closure 4 is closed, the peripheral downwardly oriented protrusion 15 formed on the upper closure 4 smoothly enters into the peripheral protrusion 14 when the upper closure 4 is closed, and the turn of the upper closure 4 is not hindered. Besides, the content is poured out from the side opposite to the hinge-coupling portion 3, and the function of the peripheral protrusion 14 for guiding the pouring is not impaired.

The outer cylinder 2 is so provided as to cover the outer peripheral surface of the skirt portion 6. As best shown in FIG. 4, the skirt portion 6 of the cap body 1 covered with the outer cylinder 2 is provided with a plurality of slits 20 extending in the axial direction maintaining a distance in the circumferential direction.

The skirt portion of the cap body 1 and the outer cylinder 2 are separated from each other via circumferential cut surfaces. The skirt portion 6 and the outer cylinder 2, however, are molded integrally together via a plurality of breakable bridge portions 22 on the upper side of the cut surfaces 21. FIG. 2A clearly shows the bridge portions 22, and FIG. 4 shows the bridge portions 22 that are remaining as designated at 22' on the skirt portion 6 and on the outer cylinder 2 (which has been removed from the cap body 1).

The outer surface of the skirt portion 6 of the cap body and the inner surface of the outer cylinder 2 are intimately contacted to each other at the cut surfaces 21 in a state (FIG. 3) where the cap body 1 is sealing the mouth 50 of the container.

When the bridge portions 22 are broken to separate the outer cylinder 2 from the cap body 1, the skirt portion 6 outwardly expands due to the action of the plurality of slits 20 formed in the skirt portion 6 of the cap body 1 and extending in the axial direction. Therefore, the recessed portion 51 on the outer peripheral side of the mouth 50 of the container is disengaged from the inwardly facing protrusion 7 of the skirt portion, and the cap body 1 is easily removed from the mouth 50 of the container. The number of the slits and their interval in the circumferential direction are suitably determined from the above-mentioned points.

In the cap of the present invention, it is desired that the skirt portion 6 is provided with the slits 20 in a number of, usually, 2 to 20 and, particularly, 8 to 12 though it may vary depending upon the diameter of the cap.

With the skirt portion 6 and the outer cylinder 2 being intimately contacted to each other at the cut surfaces 21, the skirt portion 6 of the cap body is hooped by the outer cylinder 2 in a state where the cap body 1 is fitted to the mouth 50 of the container, the skirt portion 6 is prevented from outwardly expanding, and the mouth 50 of the container is reliably sealed. In the case of the cap of the present invention in which the skirt portion 6 is provided with the slits 20 that are extending in the axial direction, the intimately contacted state plays a particularly important role. That is, the slits 20 in the skirt portion 6 work to weaken the engagement between the recessed portion 51 formed along the outer periphery of the mouth 50 of the container and the protrusion 7 of the skirt portion 6. With the hooping force of the outer cylinder 2 working thereon, however, a strong and reliable engagement is obtained.

In FIGS. 1 to 4, the skirt portion 6 of the cap body and the outer cylinder 2 are coupled together through breakable bridge portions 22 only. When the upper closure 4 coupled by the hinge to the outer cylinder 2 is pulled up or pushed down by fingers, therefore, deviation takes place between the outer cylinder 2 and the skirt portion 6 on the cut surfaces 21, and the bridge portions 22 coupling the cap body 1 to the outer cylinder 2 are easily broken by the shearing force.

FIG. 4 illustrates a state where the outer cylinder 2 is separated from the cap body 1 that is fitted and secured to the mouth 50 of the container. The skirt portion 6 of the cap body has been provided with the slits 20. When the outer cylinder 2 is removed from the skirt portion 6, therefore, the skirt portion 6 is allowed to outwardly expand in the radial direction, and the cap body can be easily separated and removed from the mouth 50 of the container without using any tool. In FIG. 4, reference numeral 22' denotes the bridge portions 22 after broken.

According to the present invention as described above, the cap after used can be separated from the container and disposed of easily.

The number and positions of the bridge portions 22 provided between the skirt portion 6 of the cap body and the outer cylinder 2 may be such that the bridge portions 22 are not broken during the capping operation and that the bridge portions 22 are easily broken when it is attempted to remove the cap body 1 from the mouth 50 of the container (i.e., when the cap is to be discarded), enabling the outer cylinder 2 to be quickly separated away from the skirt portion 6. In this sense, there is no particular limitation on the positions and number of the bridge portions. In general, it is desired that each bridge portion 22 has a sectional area of 0.1 to 1.5 $mm^2$ and, particularly, 0.2 to 1.0 $mm^2$ in the direction of cut surfaces 21 (axial direction of the cap). In the embodiment of FIGS. 1 to 4, the bridge portions 22 are provided on the upper side of the cut surfaces 21. However, the bridge portions 22 may be arranged on the lower side of the cut surfaces 21.

In the above-mentioned cap, the top plate portion 5 of the cap body 1 has the portion 11 for forming the flow-out port. The upper closure 4 is turned and is opened, and the content is poured out through the flow-out port formed in the portion 11 by breaking the score 10. The cap of this type offers very good tamper-evidence. That is, to remove the cap body 1 from the mouth 50 of the container, the outer cylinder 2 must be separated away from the cap body. In the cap of this type, therefore, the outer cylinder 2 that is separated proves that the cap is removed from the mouth 50 of the container even though the flow-out port has not been formed in the portion 11.

The present invention is in no way limited to the cap of the above-mentioned type only but can also be applied to the caps of, for example, the type in which the flow-out port has been formed from the beginning in the outer surface of the top plate portion 5 of the cap body 1. In this case, there is no improvement in the tamper-evidence, but the above-mentioned separability and sealing are accomplished to a satisfactory degree.

In the present invention as clearly shown in FIGS. 1 and 3, it is desired that the small peripheral protrusion 30 is formed at the peripheral edge on the upper surface of the top plate portion 5 of the cap body, and a horizontal surface 31 is formed on the whole inner peripheral surface of the upper closure 4 so as to come into engagement with the peripheral protrusion 30 when the upper closure 4 is closed. In the cap of the present invention, the skirt portion 6 of the cap body and the outer cylinder 2 are coupled integrally through the breakable bridge portions 22. During the capping operation and when the cap is conveyed and supplied, therefore, it is likely that the load in the axial direction may be concentrated on the bridge portions 22 causing the bridge portions 22 to be broken. With the peripheral protrusion 30 and the horizontal surface 31 being formed as described above, however, the peripheral protrusion 30 works as a stopper which receives the load in the axial direction exerted on the upper closure 4. Therefore, the pressure is effectively prevented from being concentrated on the bridge portions 22 that can be easily broken, and the bridge portions 22 are perfectly protected.

According to the present invention, it is essential that the lower end **2*a* of the outer cylinder 2 is extending up to the recessed portion 51 on the outer peripheral side of the mouth 50 of the container. That is, when the lower end 2*a* is not extending up to the recessed portion 51, the skirt portion 6 of the cap body is not tightened by the outer cylinder 2 to a sufficient degree, and satisfactory sealing is not maintained. Moreover, so far as the outer cylinder 2 has such a size, the lower end of the outer cylinder 2 may be located at a position lower than the lower end of the skirt portion 6 of the cap body as shown in FIG. 3, or may be located at a position nearly horizontal relative to the lower end of the skirt portion 6** of the cap body, or may be located at a higher position.

According to the above-mentioned embodiment, the bridge portions 22 are provided on the upper side of the cut surfaces 21. As briefly mentioned above, however, the bridge portions 22 may be provided on the lower side of the cut surfaces 21. From the standpoint of productivity, however, it is desired that the bridge portions 22 are provided on the upper side of the cut surfaces 21.

As the resin for molding the cap, there can be used a variety of plastics such as low-, medium or high-density polyethylene, linear low-density polyethylene, polypropylene, thermoplastic polyester, polyamide, styrene resin, ABS resin and the like resins.

By using the above-mentioned resin, the hinged cap of the present invention is obtained in a state where the cap body 1, outer cylinder 2 and upper closure 4 are integrally molded together by injection molding or compression molding. After this molding step, cutting is performed between the cap body 1 and the outer cylinder 2 by using a cutter or the like to form cut surfaces 21 in the portions except the bridge portions 22, so that the two are separated from each other. When the bridge portions 22 are to be provided on the upper side of the cut surfaces 21, cutting is performed by inserting the cutter or the like from the lower side of the cap. When the bridge portions 22 are to be provided on the lower side of the cut surfaces 21, the cutter or the like is inserted from the upper side of the cap in a state where the upper closure 4 is opened.

As described above, the cap of the present invention can be produced efficiently and within short periods of time in the flow of a substantially single molding step by using an ordinary metal mold comprising a core and a cavity maintaining very high productivity and high precision at each of the portions of the cap, suppressing the formation of defective products.

It is of course allowable to form the bridge portions 22 and the cut surfaces 21 simultaneously in the above step of molding. During the molding, in this case, the cap body 1 and the outer cylinder 2 are not intimately contacted to each other at portions where the cut surfaces 21 are formed. In the state where the cap body 1 is fitted to the mouth 50 of the container, however, the skirt portion 6 of the cap body are outwardly expanded and, hence, the cap body 1 and the outer cylinder 2 are intimately contacted to each other via the cut surfaces 21.

It is also possible to form the slits 20 at a subsequent step after the step of integral molding.

Figure 5:
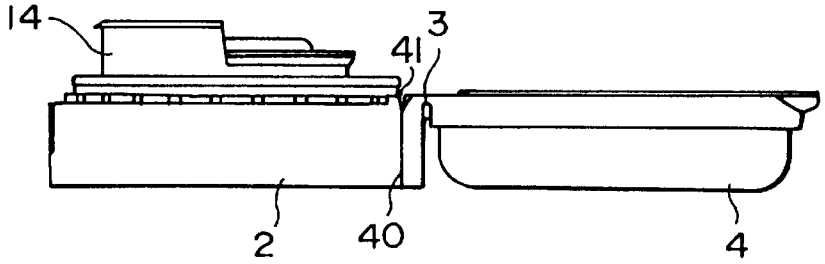
FIG. 5 is a side view illustrating another hinged cap of the present invention.

According to another embodiment of the present invention shown in FIG. 5, the outer cylinder 2 is provided with a weakened line 40 to facilitate the removal of the outer cylinder 2. As will be obvious from FIG. 5, the weakened line 40 extends in the axial direction of the outer cylinder 2 and has a notch 41 formed at the upper end thereof. That is, the outer cylinder 2 is torn away by breaking the weakened line 40 starting from the notch 41. The outer cylinder 2 that is torn away is torn off in the circumferential direction, whereby the bridge portions 22 are broken, and the outer cylinder 2 is very easily removed from the cap body 1. The weakened line is, usually, a score but may be a perforation.

It is generally desired that the score is formed on the outer surface of the outer cylinder 2.

The notch 41 may be formed at the lower end of the weakened line 40.

Figure 6:
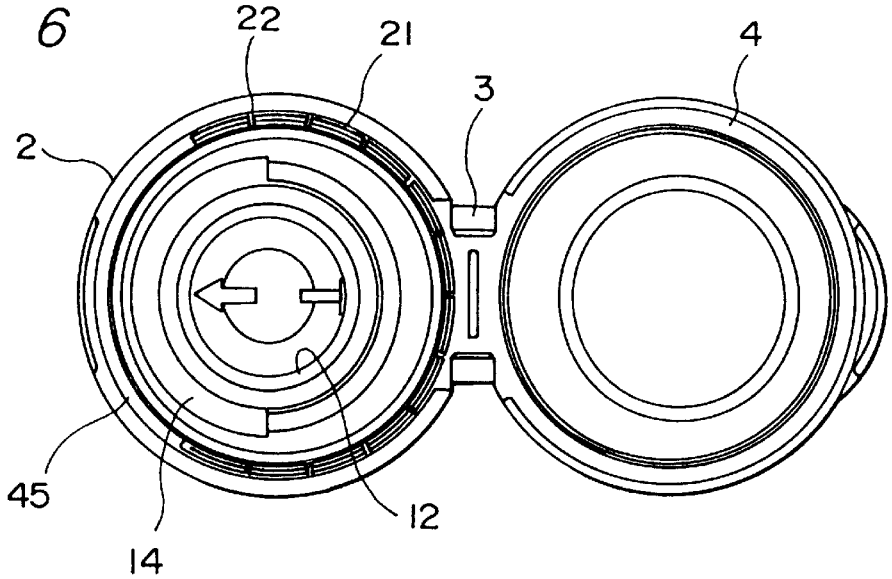
FIG. 6 is a top view of a further hinged cap of the present invention.

In the above-mentioned embodiment of FIG. 1, the outer cylinder 2 and the skirt portion 6 of the cap body are coupled integrally through the breakable bridge portions 22 only. It is, however, also possible to form a coupling portion that cannot be broken between the two together with the bridge portions 22. This embodiment is shown in FIG. 6 which is a top view of the hinged cap in a state where the upper closure is opened, wherein a coupling portion is provided as designated at 45. The coupling portion 45 is wider than the bridge portions 22 and cannot be easily broken. If the outer cylinder 2 is turn off with the coupling portion 45 as a fulcrum, the bridge portions 22 are broken and the skirt portion 6 is liberated from the hooping force. By pulling up the outer cylinder 2 formed integrally with the upper closure 4 in this state, therefore, the cap body 1 can, at the same time, be removed from the mouth 50 of the container.

The coupling portion 45 can be easily formed by so effecting the cutting for forming the cut surfaces 21 as to leave the bridge portions 22 and the coupling portion 45.

When the coupling portion 45 is to be formed in the hinged cap of FIG. 5, it is desired to form the coupling portion 45 at a position away from the break-starting portion (notch 41) of the weakened line 40.

The cap of the present invention can be efficiently produced through a series of molding steps maintaining a very high productivity.

In the capped and sealed state, the skirt portion of the cap body is intimately contacted to the mouth of the container being tightened by the outer cylinder to establish a reliable sealing structure. The cap can be easily removed from the mouth of the container without using any particular tool. Therefore, the cap after used can be separated easily from the container at the time of disposal.

Besides, the cap of the type having a portion where the port will be formed offers excellent tamper-evidence.

We claim:

1. A hinged cap comprising:

a cap body including a top plate portion and a skirt portion, the top plate portion having a portion for forming a flow-out port, the skirt portion having a protrusion formed on the inner surface thereof to engage with the mouth of a container;

an outer cylinder formed integrally with said cap body so as to cover the outer surfaces of said cap body and said skirt portion; and an upper closure coupled by a hinge to the upper end portion of said outer cylinder;

wherein the skirt portion of said cap body is provided with a plurality of slits extending in the axial direction maintaining a distance in the circumferential direction, the skirt portion of said cap body and said outer cylinder are separated away from each other via cut surfaces but are formed integrally together via a plurality of breakable bridge portions that are formed on the upper or lower side of the cut surfaces, and the outer surface of the skirt portion of the cap body and the inner surface of the outer cylinder are intimately contacted to each other at the cut surfaces in a state where at least the cap body is fitted to the mouth of the container.

2. A hinged cap according to claim 1, wherein a small peripheral protrusion is formed at the peripheral edge on the upper surface of the top plate portion of the cap body, and a horizontal surface is formed on the inner surface of the upper closure so as to come into contact with the upper end of said peripheral protrusion.

3. A hinged cap according to claim 1, wherein the outer surface of the skirt portion of said cap body and the inner surface of the outer cylinder are formed being separated away from each other via the cut surfaces at portions except the breakable bridge portions by cutting after injection-molding or compression-molding.

4. A hinged cap according to claim 1, wherein said skirt portion of said cap body and said outer cylinder are coupled together via said breakable bridge portions and a coupling portion that cannot be broken.

5. A hinged cap according to claim 1, wherein said top plate portion has the portion for forming the flow-out port sectionalized by a score.

6. A hinged cap according to claim 1, wherein said outer cylinder has a weakened line extending from the lower end thereof toward the upper end thereof.

7. A hinged cap according to claim 6, wherein said weakened line is located near a portion where said upper closure and said outer cylinder are coupled together by the hinge, and a notch is formed at the upper end or the lower end of said weakened line.

* * * * *